US005123946A

United States Patent [19]

Ha

[11] Patent Number: 5,123,946

[45] Date of Patent: Jun. 23, 1992

[54] CRYOGENIC NITROGEN GENERATOR WITH BOTTOM REBOILER AND NITROGEN EXPANDER

[75] Inventor: Bao Ha, Vacaville, Calif.

[73] Assignee: Liquid Air Engineering Corporation, Walnut Creek, Calif.

[21] Appl. No.: 570,771

[22] Filed: Aug. 22, 1990

[51] Int. Cl.[5] ..... F25J 3/00

[52] U.S. Cl. ..... 62/11; 62/39

[58] Field of Search ..... 62/11, 38, 39

[56] References Cited

U.S. PATENT DOCUMENTS 3,500,651 3/1970 Becker ..... 62/39
4,594,085 6/1986 Cheung ..... 62/38
4,662,916 5/1987 Agrawal et al. ..... 62/39
4,707,994 11/1987 Shenoy et al. ..... 62/38
4,783,210 11/1988 Ayres et al. ..... 62/24
4,834,785 5/1989 Ayres ..... 62/38

*Primary Examiner*—Ronald C. Capossela
*Attorney, Agent, or Firm*—Oblon, Spivak, McClelland, Maier & Neustadt

[57] ABSTRACT

A process of producing nitrogen by cryogenic separation of air in a single distillation column process, in which cooled feed air is passed to a reboiler heat exchanger in a distillation column, whereby in the column a portion of a formed nitrogen-rich stream is used for reflux, and the remaining portion is recovered as vapor and liquid product, and a portion of a formed oxygen-rich stream is used for reflux, and a remaining portion is recovered as product, and wherein the nitrogen-rich stream is used to provide process refrigeration.

10 Claims, 1 Drawing Sheet

CRYOGENIC NITROGEN GENERATOR WITH BOTTOM REBOILER AND NITROGEN EXPANDER

BACKGROUND OF THE INVENTION

1. Field of the Invention

The present invention relates to the production of nitrogen by cryogenic separation of air in a single distillation column process.

2. Discussion of the Background

The production of nitrogen by cryogenic separation of air in a single column process is widely used at present. The conventional process affords nitrogen at pressures of about 5–8 bar. With this process, liquid nitrogen is obtainable, however, recovery is limited by equilibration at the bottom of the column. Generally, this process allows for the recovery of about 50–60% of the nitrogen in the air feed. The required refrigeration for the process is obtained by expanding the waste stream from about 2–5 bar to atmospheric pressure.

It would be extremely desirable to use such a process to produce nitrogen, at higher recoveries and lower pressures of about 1.5–4 bar, however, it is not feasible at present to use the conventional single-column process for the production of nitrogen at such lower pressures for a variety of reasons.

First, a low nitrogen pressure results in a low waste pressure. This is especially problematic for plants of small size, whereby waste expansion is no longer sufficient to provide the required refrigeration. Moreover, liquid production would be difficult.

Second, a low nitrogen pressure also means a low air pressure at the inlet of the cold box. At low pressure the removal of water vapor and carbon dioxide becomes expensive and is not economically feasible.

Third, although a single distillation column process for the production of nitrogen would, in theory, produce an oxygen-enriched stream, as a waste stream, the conventional process cannot be used to produce an oxygen-enriched stream under pressure since it would result in significant back pressure at the outlet of the expander.

Thus, a need clearly continues to exist for an economical process for the production of nitrogen of high purity and high recovery at lower nitrogen pressures and with the capability of producing a small amount of liquid product.

SUMMARY OF THE INVENTION

Accordingly, it is an object of the present invention to provide an economical process having a relatively low power consumption for the production of nitrogen of high purity and with high recovery, at low nitrogen pressures and with the capability of producing a small amount of liquid product.

It is also an object of the present invention to provide a process for the recovery of nitrogen which can recover greater amounts of nitrogen from the feed air.

Further, it is an object of the present invention to provide an oxygen-enriched stream available under pressure.

Accordingly, these objects and others are provided by a single distillation column process for the production of nitrogen, which entails:

a) cooling a feed air substantially free of impurities in a main heat exchanger, such that feed air exchanges heat with outgoing products, b) passing feed air to a reboiler heat exchanger at the bottom of a distillation column, in fluid connection with said heat exchanger, where said feed air is condensed by heat exchange with vaporizing liquid to form liquefied air, thereby providing a reboil to said distillation column, c) passing liquefied air from the bottom reboiler to the distillation column at a tray below the top tray and at least one theoretical tray above the reboiler, thereby separating the liquefied air in the column into a nitrogen-rich vapor stream at the top, and an oxygen-rich liquid stream at the bottom of the column, d) condensing a portion of the nitrogen-rich stream in an overhead condenser to form liquefied nitrogen, and returning a portion of the same to the top of the column to provide reflux for distillation, recovering a second portion of the nitrogen-rich stream as a vapor product and warming the same in said main heat exchanger, and recovering the remaining portion of liquefied nitrogen as product, e) vaporizing a portion of the oxygen-rich liquid fraction in the reboiler against condensing air to provide a reboil for distillation, and removing a remaining portion of the oxygen-rich liquid as a bottom stream from the distillation column, f) subcooling said oxygen-rich liquid bottom stream in a subcooler by outgoing product, and expanding said oxygen-rich liquid bottom stream at reduced pressure, g) vaporizing said oxygen-rich stream in said overhead condenser, and warming the same in said subcooler and said heat exchanger, said stream exiting said main heat exchanger as an oxygen-rich stream by-product, and h) expanding said nitrogen-rich stream from said main heat exchanger to lower pressure in an expander to provide process refrigeration, then warming said nitrogen-rich stream exiting from the expander in said main heat exchanger, said nitrogen-rich stream then exiting said main heat exchanger as product.

DETAILED DESCRIPTION OF THE PREFERRED EMBODIMENTS

Figure 1:
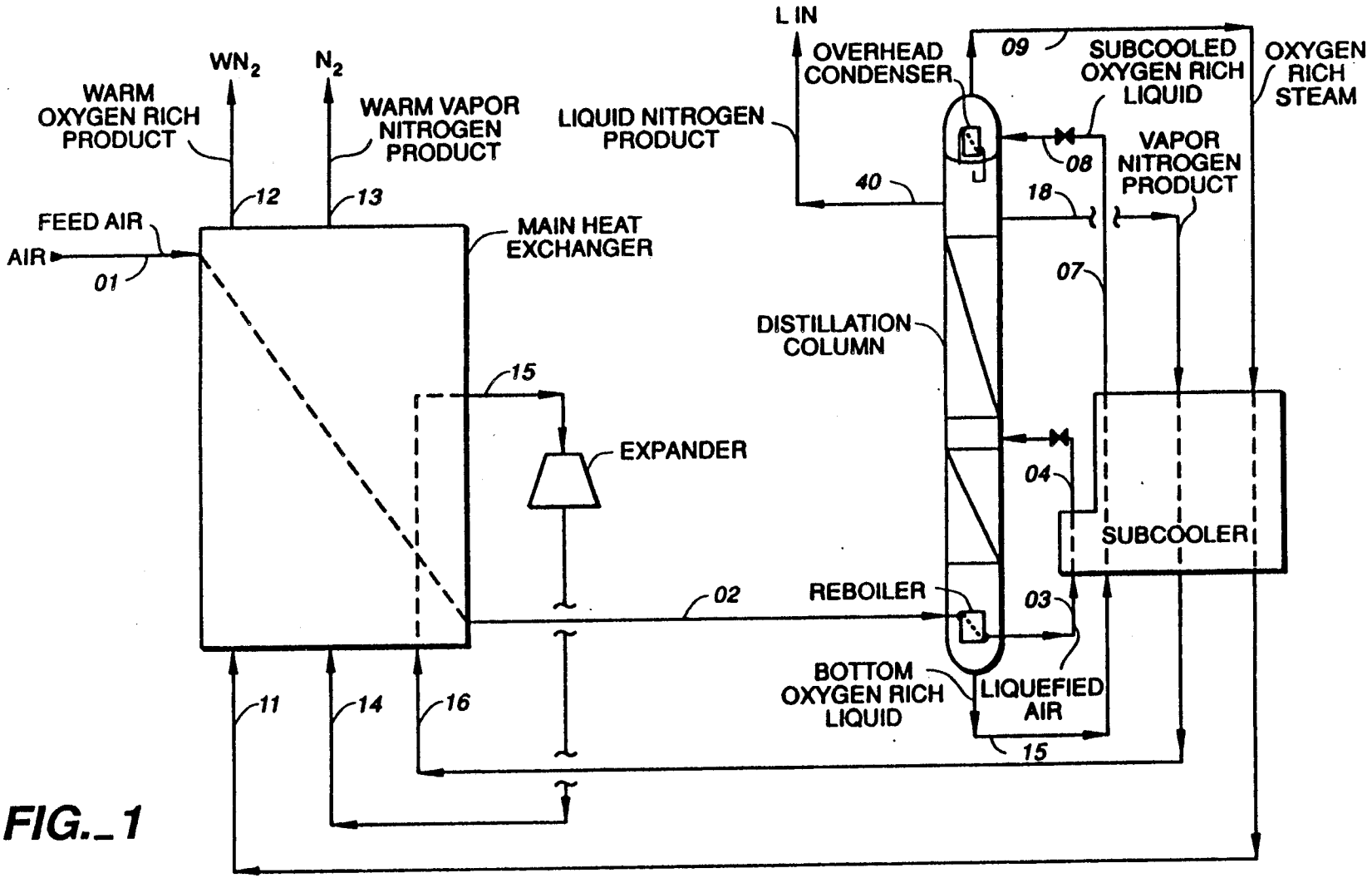
FIG. 1 illustrates a schematic diagram of the operation of the process of the present invention.

In accordance with the present invention, a single distillation column process is provided for the efficient production of nitrogen by cryogenic distillation. The present process affords nitrogen production with relatively low power consumption, while also producing an oxygen-enriched stream under pressure. The pressurized oxygen-enriched stream may then be used in several applications, such as improving the efficiency of a furnace.

In contrast to the conventional single distillation column process for the production of nitrogen, the present process is quite advantageous as it produces nitrogen at relatively low pressure. For example, the present process can product nitrogen at a pressure of about 1 bar to 6 bar obsolete. Nitrogen pressures at about 2 bar to 4 bar are preferred, however. The present process is also advantageous as it allows for the production of an oxygen-enriched stream, or waste stream, at pressures of from about 1 bar to 4 bar. The present process may be described, generally, as follows, with reference to FIG. 1.

First, feed air substantially free of impurities is introduced via conduit 01 to and cooled down in the main heat exchanger where the feed air exchanges heat with outgoing products. The feed air is generally introduced into the main exchanger at a pressure of about 4 to 10 bar, however, a pressure of about 6 to 8 bar is preferred. In order to remove impurities such as $H_2O$ vapor and $CO_2$ from the feed air prior to the introduction of the same into the main heat exchanger, the feed air is purified by adsorption on molecular sieves or by utilizing any other process familiar to those skilled in the art. Then, feed air is passed through conduit 02 to a bottom reboiler exchanger located at the bottom of a distillation column where it is condensed by heat exchange with vaporizing liquid, thus providing a reboil to the distillation column. Typically, the column may operate at pressure of from about 4 bar to 10 bar, however, it is preferred that the column operates at a pressure of from about 6 bar to 8 bar.

Then, the liquefied air leaving the bottom reboiler via conduit 03 is then fed to the distillation column below the top tray and at least one theoretical tray above the bottom reboiler. Some subcooling of the liquefied air stream can be achieved against the outgoing product-/waste in a subcooler.

The distillation column separates the air feed into a nitrogen-rich vapor stream at the top of the column and an oxygen-rich liquid stream at the bottom thereof. A portion of the nitrogen-rich stream is condensed in an overhead condenser and is returned to the top of the column to provide the required reflux for distillation. A portion of this liquefied nitrogen stream may be recovered as liquid product via conduit 40. A portion of the nitrogen-rich stream at the top of the column can be recovered as vapor product via conduit 18. This vapor product, after being warmed in the main exchanger is expanded to approximately the desired product pressure in the expander to provide the required refrigeration.

A portion of the oxygen-rich liquid fraction is vaporized in the bottom reboiler against condensing air to provide the required reboil for distillation. The remaining portion of the oxygen-rich liquid exits the column as a bottom stream via conduit 05. This bottom stream, after being subcooled in the subcooler by the outgoing nitrogen and oxygen rich product streams is then expanded at reduced pressure and is vaporized in the overhead condenser.

The vaporized oxygen-rich stream is then warmed in the subcooler and the main heat exchanger and leaves the cold box as an oxygen-rich stream by-product.

In contrast to the conventional single column process for nitrogen production, which affords a recovery of about 50–60% of the nitrogen in the air feed, much higher nitrogen recoveries are obtainable with the present process. For example, a nitrogen recovery of about 70% of the nitrogen contained in the feeder is obtainable with the present process.

The process of the present invention will now be explained in more detail, again, referring to FIG. 1

The feed air used is substantially free of impurities such as water and carbon dioxide and must be purified to accomplish this purpose. A conventional feed air purifying means may be used. This air is introduced via conduit 01 to a main heat exchanger where the air is cooled down by exchanging heat with the outgoing warm oxygen-rich product of conduit 12 and the warm nitrogen product of conduit 13.

Then, feed air is passed through conduit 02 to a bottom reboiler exchanger located at the bottom of a distillation column where it is condensed by heat exchange with vaporizing liquid, thus providing a reboil to the distillation column.

The liquefied air leaving the bottom reboiler via conduit 03 is fed to the distillation column on at least one theoretical tray above the bottom reboiler. Some subcooling of the liquefied air stream can be achieved against the outgoing products in a subcooler.

The distillation column affords separation of the air feed into a nitrogen-rich vapor stream at the top of the column and an oxygen-rich liquid stream at the bottom thereof. A portion of the nitrogen-rich stream is condensed in an overhead condenser and is returned to the top of the column to provide the necessary reflux for distillation. A portion of this liquefied nitrogen stream may be recovered as liquid product via conduit 40. A portion of the nitrogen-rich stream at the top of the column can be recovered as vapor product via conduit 18. This vapor product is passed through a subcooler, warmed in the main exchanger, then expanded in the expander and it is then sent through conduit 14 to the main heat exchanger where it is warmed by the entering air and leaves the main heat exchanger through conduit 13. The expander provides the refrigeration required by the unit and lowers the pressure of nitrogen product so that it is at the desired pressure when it leaves the main heat exchanger.

Thereafter, a portion of the oxygen-rich liquid fraction is vaporized in the reboiler against condensing air to provide the required reboil for distillation. The remaining portion of the oxygen-rich liquid exits the column as a bottom stream via conduit 05. The bottom stream is then subcooled in the subcooler and leaves the subcooler through conduit 7 by outgoing products, expanded at reduced pressure and vaporized in the overhead condenser.

The vaporized oxygen-rich stream exits the condenser via conduit 09 and is then warmed in the subcooler, and the main heat exchanger passing through conduits 10, 11 and 12 and finally leaves the cold box as an oxygen-rich stream by-product.

Generally, feed air is fed to the main heat exchanger at a pressure of about 4 to 10 bar, preferably 6 to 8 bar. The temperature of the feed air is generally ambient, while the temperature of the "warm" oxygen-rich and vapor nitrogen products is preferably about 2° to 8° C. below the feed air temperature.

Although at least one theoretical tray is required between the liquid feed air and the bottom reboiler, it is possible to use from 1 to 8 such trays, preferably from 1 to 5.

The operable and preferred pressure ranges of the liquified air in conduits 03 and 04 are the same as the feed air pressure range.

The concentration of nitrogen in the vapor nitrogen product and liquid nitrogen product is very high. It is possible to obtain such high purities that the oxygen concentration may be maintained at less than 0.1 ppm. The concentration of oxygen in the vaporized oxygen-rich stream is generally about 35 to 50%, with the remainder being essentially $N_2$ and some argon.

The liquid and vapor nitrogen products are each at a pressure in the range of about 4 to 10 bar and temperature of about −180° C. to −170° C. when exiting the distillation column. The vaporized oxygen-rich stream exits the distillation column at a pressure in the range of about 1.5 to 3 bar and a temperature of about −182° C. to −172° C. Generally, the temperature of the vaporized oxygen-rich stream is about 2-3° C. colder than the temperature of the nitrogen product streams.

The bottom oxygen-rich liquid exiting the distillation column has an oxygen concentration of about 35 to 50%. This liquid is at a temperature in the range of −180° C. to −167° C., and is at a pressure of about 4 to 10 bar. While it is not essential that the bottom oxygen-rich liquid exiting the distillation column be subcooled, such subcooling is preferred as, thereby, the process efficiency is improved.

Generally, in order for the subcooled oxygen-rich stream to vaporize in the overhead condenser, it is necessary that the temperature in the condenser be less than the condensing temperature of nitrogen at the top of the column.

The expander illustrated in FIG. 1 is a conventional turbo-expander which is commercially available.

Having described the present invention, reference will now be made to an Example which is offered solely for purposes of illustration and which is not intended to be limitative.

EXAMPLE

Utilizing the pressures and conditions described above, the following temperatures and pressures were observed at various points throughout the system as illustrated in FIG. 1. A feed air pressure of 7.5 bar was used, and the nitrogen pressure at the top of the column was 5 bar, with a temperature of −179° C.

| LOCATION (stream) | T °C. | P (bar) |
|---|---|---|
| 18 | −179 | 5 |
| 7 | −176 | — |
| 6 | −173 | — |
| 9 | −181 | 2.2 |
| 10 | −178 | — |
| 11 | −174 | — |
| 12 | 23 | 2 |
| 17 | −178 | — |
| 16 | −174 | — |
| 15 | −140 | — |
| 14 | −153 | — |
| 13 | 23 | 3.1 |

"—" indicates not measured.

Thus, from the above, the present invention may be seen to provide three principle advantages. First, liquid nitrogen and vaporized nitrogen are provided as products, and the pressure of the vaporized nitrogen product is low. In the above Example, for example, the pressure of the nitrogen at the top of the column was reduced from 5 bar to 3.1 bar for the warm vapor nitrogen product. Second, an oxygen-rich waste stream is produced under pressure. Third, the recovery of product is quite high.

The above advantages are surprisingly attained, generally, by using a bottom reboiler to improve distillation, and then expanding the product to low pressure. Any additional modifications to the present invention, other than as described above, which have the effect of attaining the above listed advantages and using the above general means of accomplishing the same are considered to be within the ambit of the present invention.

Having described the above invention, it will be apparent to one of skill in the art that many changes and modifications can be effected to the above embodiments while remaining within the spirit and the scope of the present invention.

What is claimed as new and desired to be secured by letters patent of the United States is:

1. A process of producing nitrogen by cryogenic separation of air in a single distillation column process, which comprises:

a) cooling a feed air substantially free of impurities in an exchanger, such that feed air exchanges heat with outgoing products, b) passing said feed air to a reboiler exchanger at the bottom of a distillation column, in fluid connection with said exchanger, where said feed air is condensed to form the liquefied air by heat exchange with vaporizing liquid from the bottom of the column, thereby providing a reboil to said distillation column, c) passing said liquefied air from said reboiler to the distillation column on at least one theoretical tray above the reboiler but below the top tray, thereby separating said liquefied air in said column into a nitrogen-rich vapor stream at the top, and an oxygen-rich liquid stream at the bottom of said column, d) condensing a portion of the nitrogen-rich stream in an overhead condenser to form liquefied nitrogen and returning a portion of the same to the top of the column to provide reflux for distillation, recovering a second portion of the nitrogen-rich stream from the top of said distillation column as a vapor product, and warming the same in said main exchanger, and recovering the remaining portion of liquefied nitrogen as product, e) vaporizing a portion of the oxygen-rich liquid fraction in the reboiler by heat exchange with condensing air to provide a reboil for distillation, and removing a remaining portion of the oxygen-rich liquid as a bottom stream from the distillation column, f) subcooling said oxygen-rich liquid bottom stream in a subcooler by outgoing products, and expanding said oxygen-rich liquid bottom stream to reduced pressure, g) vaporizing said oxygen-rich stream in said overhead condenser, and warming the same in said subcooler and said exchanger, said stream exiting said cold box as an oxygen-rich stream by-product, and h) expanding said nitrogen-rich stream from said main exchanger to lower pressure in an expander to provide process refrigeration, then warming said nitrogen-rich stream exiting from the expander in said main exchanger, said nitrogen-rich stream then exiting said main exchanger as product.

2. The process of claim 1, which further comprises passing said nitrogen-rich stream from said distillation column through at least one subcooler, then said exchanger, and an expander, thereby warming said nitrogen-rich stream and adjusting the pressure of said stream.

3. The process of claim 2, wherein said portion of nitrogen-rich stream recovered as a vapor product is at a pressure of about 1 to 6 bar.

4. The process of claim 3, wherein said portion of nitrogen-rich stream recovered as a vapor product is at a pressure of about 2 to 4 bar.

5. The process of claim 1, wherein said oxygen-rich stream by-product exiting said cold box is at a pressure of about 2 to 4 bar.

6. The process of claim 1, wherein said distillation column is operated at a pressure in the range of 4 to 10 bar.

7. The process of claim 1, wherein said distillation column is operated at a pressure in the range of 6 to 8 bar.

8. The process of claim 1, wherein said nitrogen is produced in a yield of up to about 70% based upon the input of said feed air.

9. An apparatus for producing nitrogen by cryogenic separation of air in a single distillation column, which comprises:

a) an exchanger having an input for feed air and one or more outputs for product gas, said exchanger being in fluid connection with a bottom reboiler exchanger at the bottom of a distillation column;

b) a distillation column having a reboiler in a bottom portion thereof, an overhead condenser in an upper portion thereof, said upper portion having a first output for liquid nitrogen, a second output for a nitrogen-rich vapor stream, and a third output for an oxygen-rich stream, and said bottom portion having a fourth output for an oxygen-rich liquid;

c) an expander in fluid connection with said second output for said nitrogen-rich vapor product, said expander being in fluid connection with said exchanger and one of said product outputs; and d) a subcooler in fluid connection with said nitrogen-rich vapor product, and said oxygen-rich stream, and being upstream of said expander for said nitrogen-rich vapor product stream.

10. The apparatus of claim 9, which further comprises means for passing said nitrogen-rich vapor product through at least one subcooler, an exchanger and an expander in order to effect warming of said nitrogen-rich vapor product and to adjust the pressure of the same.

* * * * *